US012221918B2

(12) United States Patent
Ohler et al.

(10) Patent No.: US 12,221,918 B2
(45) Date of Patent: Feb. 11, 2025

(54) COOLING SYSTEM FOR A GAS ENGINE PISTON, GAS ENGINE, COOLING METHOD FOR GAS ENGINE PISTON

(71) Applicant: Caterpillar Energy Solutions GmbH, Mannheim (DE)

(72) Inventors: Sebastian Ohler, Dannstadt-Schauernheim (DE); Olaf Berger, Dudenhofen (DE)

(73) Assignee: Caterpillar Energy Solutions GmbH, Mannheim (DE)

( * ) Notice: Subject to any disclaimer, the term of this patent is extended or adjusted under 35 U.S.C. 154(b) by 0 days.

(21) Appl. No.: 18/143,038

(22) Filed: May 3, 2023

(65) Prior Publication Data

US 2023/0374931 A1 Nov. 23, 2023

(30) Foreign Application Priority Data

May 20, 2022 (GB) ..... 2207389

(51) Int. Cl.
*F01P 7/16* (2006.01)
*F01P 3/08* (2006.01)

(52) U.S. Cl.
CPC ..... *F01P 7/16* (2013.01); *F01P 3/08* (2013.01); *F01P 2025/04* (2013.01); *F01P 2025/08* (2013.01)

(58) Field of Classification Search
CPC ..... F01P 2025/08; F01P 2025/04; F01P 3/08; F01P 7/16
See application file for complete search history.

(56) References Cited

U.S. PATENT DOCUMENTS

| | | | | |
|---|---|---|---|---|
| 7,661,416 | B2 | 2/2010 | Sasajima et al. | |
| 9,334,766 | B2 * | 5/2016 | Mordukhovich | F01M 1/08 |
| 9,989,007 | B2 | 6/2018 | Shibata | |
| 2014/0251240 | A1 | 9/2014 | Bidner et al. | |
| 2017/0016364 | A1 | 1/2017 | Kazaoka et al. | |

(Continued)

FOREIGN PATENT DOCUMENTS

| | | | |
|---|---|---|---|
| CN | 102454467 | A | 5/2012 |
| CN | 113266455 | A | 8/2021 |

(Continued)

OTHER PUBLICATIONS

European Extended Search Report for Europe Patent Appln. No. 23171007.0, mailed Sep. 28, 2023 (6 pgs).

*Primary Examiner* — Kevin A Lathers

(57) ABSTRACT

The present invention pertains A cooling system for a gas engine piston, the system comprising a cooling oil supply configured to feed a cooling oil flow to the gas engine piston, and a control device configured to control the cooling oil flow based at least on a predetermined parameter. The present invention further pertains to a gas engine comprising at least one gas engine piston and a cooling system according to any of the previous claims, wherein the gas engine piston is configured to be operable with at least one combustion gas. In addition, the present disclosure pertains to a cooling method for a gas engine piston, comprising the steps of receiving at least one predetermined parameter at the control device; controlling the cooling oil flow based on at least the predetermined parameter; and observing a sufficient cooling oil flow fed to the gas engine piston.

13 Claims, 7 Drawing Sheets

(56) References Cited

U.S. PATENT DOCUMENTS

| | | | |
|---|---|---|---|
| 2021/0079819 | A1 | 3/2021 | Lee et al. |
| 2021/0198957 | A1 | 7/2021 | Hellman |

FOREIGN PATENT DOCUMENTS

| | | | |
|---|---|---|---|
| JP | 2016118130 | A | 6/2016 |
| WO | 2010092684 | A1 | 8/2010 |
| WO | 2020196361 | A1 | 10/2020 |

* cited by examiner

COOLING SYSTEM FOR A GAS ENGINE PISTON, GAS ENGINE, COOLING METHOD FOR GAS ENGINE PISTON

CROSS-REFERENCE TO RELATED APPLICATION

This application claims priority under 35 USC § 119 and the Paris Convention to Great Britain Patent Application 2207389.4 filed on May 20, 2022.

TECHNICAL FIELD

The present disclosure pertains to a cooling system for a gas engine piston. In particular, the present disclosure pertains to a cooling system for a gas engine piston operable with combustion gases of different hydrogen/hydrocarbon gas substitution ratios. The present disclosure also pertains to a gas engine comprising such cooling system. Further, the present disclosure pertains to a cooling method for a gas engine piston.

TECHNOLOGICAL BACKGROUND

Growing awareness of the detrimental effects associated with conventional fossil fuel emissions have made natural gas (NG) an attractive alternative for internal combustion engines (ICEs), particular for being environment friendly, clean burning, economical, and efficient.

Combustion gas mixtures consisting of hydrocarbon and hydrogen gases are considered a viable option to further the cleanliness of gas engine cycles. Such hydrogen/hydrocarbon gas blends can offer improved flame speeds, a wider flammability range, lower minimum ignition energy, and reduced emissions.

Gas engine piston cooling has been an important field of research and development. For gas engines using only hydrocarbon gases, piston cooling is well understood.

However, for gas engines combusting different hydrogen/hydrocarbon gas substitution ratios, existing piston cooling systems reach their limits. For example, premature ignitions are observed.

In view thereof, improved piston temperature control systems are needed to compensate for the associated thermodynamic changes.

The cooling system for a gas engine piston, the gas engine comprising such, and the cooling method of the present disclosure solve one or more problems set forth above.

SUMMARY OF THE INVENTION

Starting from the prior art, it is an objective to provide a simple, cost-effective, and reliably operating cooling system for a gas engine piston. It is also an objective to provide a reliable prevention of pre-ignition incidents in gas engines using combustion gases of different hydrogen/hydrocarbon gas substitution ratios.

These objectives are solved by means of a cooling system for a gas engine piston, a gas engine comprising such system, and a cooling method for a gas engine piston. Preferred embodiments are set forth in the present specification, the Figures as well as the dependent claims.

Accordingly, a cooling system for a gas engine piston is provided. The cooling system comprises a cooling oil supply configured to feed a cooling oil flow to the gas engine piston, and a control device configured to control the cooling oil flow based at least on a predetermined parameter.

Furthermore, a gas engine comprising at least one piston, operable with at least one combustion gas, and a cooling system according to the present disclosure for the gas engine piston is provided.

Process-wise, a cooling method for a gas engine piston is provided, comprising a cooling oil supply configured to feed a cooling oil flow to the gas engine piston, and a control device configured to control the cooling oil flow based at least on a predetermined parameter. The method according to the present disclosure comprises the steps of receiving at least one predetermined parameter at the control device, controlling the cooling oil flow based on at least the predetermined parameter, and observing a sufficient cooling oil flow fed to the gas engine piston.

BRIEF DESCRIPTION OF THE DRAWINGS

The present disclosure will be more readily appreciated by reference to the following detailed description when being considered in connection with the accompanying drawings in which.

DETAILED DESCRIPTION OF PREFERRED DEVELOPMENTS

Figure 1:
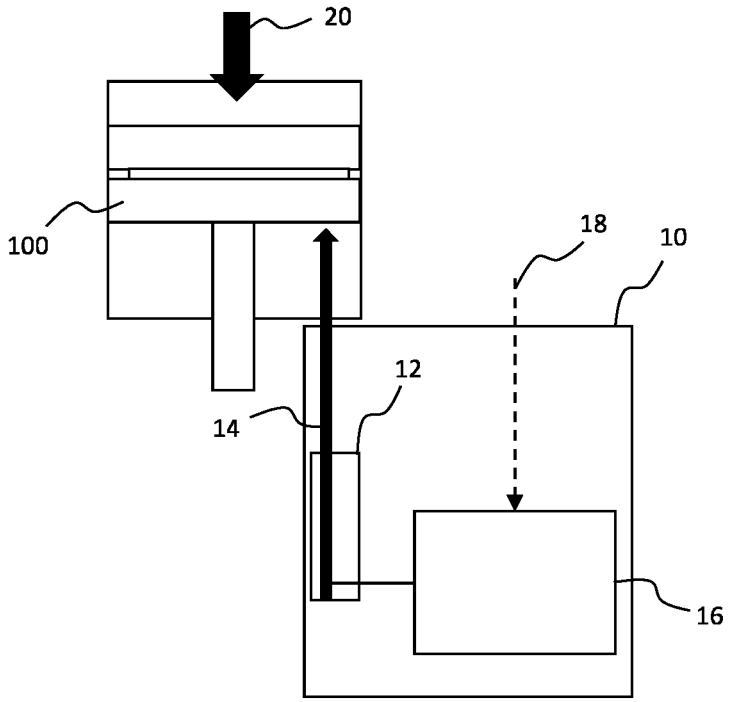
FIG. 1 schematically shows a cooling system for a gas engine piston according to a first embodiment.

In the following, the invention will be explained in more detail with reference to the accompanying figures. In the Figures, like elements are denoted by identical reference numerals and repeated description thereof may be omitted in order to avoid redundancies.

The present disclosure is generally directed towards a gas engine piston cooling system capable of cooling gas engine pistons, or gas engines, using one or more hydrocarbon-hydrogen blends as feedstock. The present disclosure aims to utilize control approaches which are not solely reliant on real-time parameters such as the piston temperature. Instead, the present disclosure proposes to base the cooling oil flow control at least on a predetermined parameter. Thereby, the cooling oil flow may be controlled in a way component, operation, and maintenance complexity and costs are reduced. Further, it is thereby possible to provide a reliable prevention of pre-ignition incidents in gas engines using combustion gases of different hydrogen/hydrocarbon gas substitution ratios.

Thereto, the present invention and its underlying principles are explained exemplary for a cooling system for a gas engine piston.

In FIG. 1, a cooling system 10 for a gas engine piston 100 is schematically shown. The cooling system 10 comprises a cooling oil supply 12 configured to feed a cooling oil flow 14 to the gas engine piston 100. The cooling system 10 further comprises a control device 16 configured to control the cooling oil flow 14 based at least on a predetermined parameter 18.

The gas engine piston 100 may be configured to be operable with a combustion gas 20, preferably a combustion gas 20 having different hydrogen/hydrocarbon gas substitution ratios. More preferably, the gas engine piston 100 may be configured to be operable with combustion gases 20 having different hydrogen/hydrocarbon gas substitution ratios. The gas engine piston 100 may be part of a gas engine of the internal combustion engine, ICE, type. The cooling oil used in the cooling oil flow 14 may be engine oil taken from an oil sump of the gas engine piston (not shown in FIG. 1).

The predetermined parameter 18 may be one or more analogue signals in the form of continuous signals that represent physical measurements or inputs. Alternatively, the predetermined parameter 18 may be a digital signal in the form of one or more time-separated signals which are generated using digital modulation. Further, the predetermined parameter 18 may be an input signal of the control device 16. The predetermined parameter 18 may be a parameter which is determined pre-combustion. For example, prior to operating the gas engine piston 100 or prior to combusting a different combustion gas in the gas engine piston 100.

Using such a predetermined parameter allows controlling the piston temperature without solely relying on real-time parameters such as a gas piston temperature. However, using such a predetermined parameter 18 does not exclude having additional parameters as a basis to control the cooling oil flow.

Figure 2:
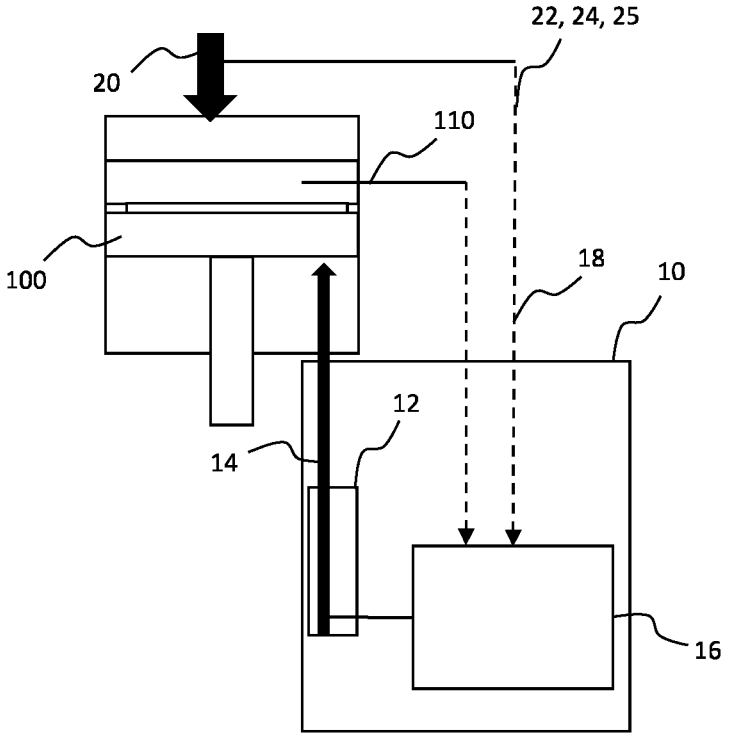
FIG. 2 schematically shows a cooling system for a gas engine piston according to a further embodiment.

In FIG. 2, a cooling system 10 for a gas engine piston 100 according to another development is shown exemplarily. The development shown in FIG. 2 differs from FIG. 1 in that the predetermined parameter 18 may be a function of a combustion gas 20, and in that the control device 16 of FIG. 2 may be configured to control the cooling oil flow 14 further based on a gas piston temperature 110. Thereby, the cooling oil flow 14 may be controlled based on temperature of the piston 100 and a combustion gas 20.

In a further development, the predetermined parameter 18 may be a function of a combustion gas concentration 22, a hydrogen concentration 24, and/or a hydrogen/combustion gas substitution ratio 25. Further, the predetermined parameter 18 and the piston temperature 110 may be used as an input for the control device 16. The predetermined parameter 18 may comprise the combustion gas concentration 22, the hydrogen concentration 24, and/or the hydrogen/combustion gas substitution ratio 25 as explicit or implicit information in an analogue or digital signal as defined in the context of FIG. 1.

According to a further development, also shown in FIG. 2, the control device 16 may be configured such that the cooling oil flow 14 is restricted when the hydrogen concentration 24 is increased, and/or wherein the cooling oil flow 14 is exceeded when the hydrogen concentration 24 is decreased.

Further, the control device 16 may be configured such that the cooling oil flow 14 is a minimum when the hydrogen concentration 24 is at a maximum, preferably wherein the cooling oil flow 14 is at a maximum when the hydrogen concentration 24 is at a minimum.

Pertaining to the above, hydrogen/hydrocarbon gas substitution ratios can be used interchangeably with the hydrogen concentration.

Such control device 16 configurations are based on the observation that hydrogen presence in the combustion gas is positively correlated with less piston heat-up, hence a reduction in piston cooling requirement.

More specifically, when combusting gases having a higher hydrogen concentration, or higher hydrogen/hydrocarbon gas substitution ratio, lower temperature occur compared to gas engines running on natural gas. Due to this lower temperature, oil deposits will not be removed by evaporation. Therefore, it is necessary to prevent pre-ignition by reducing the build-up of oil deposits on the piston, which can be achieved by the cooling system according to the present disclosure.

Figure 3:
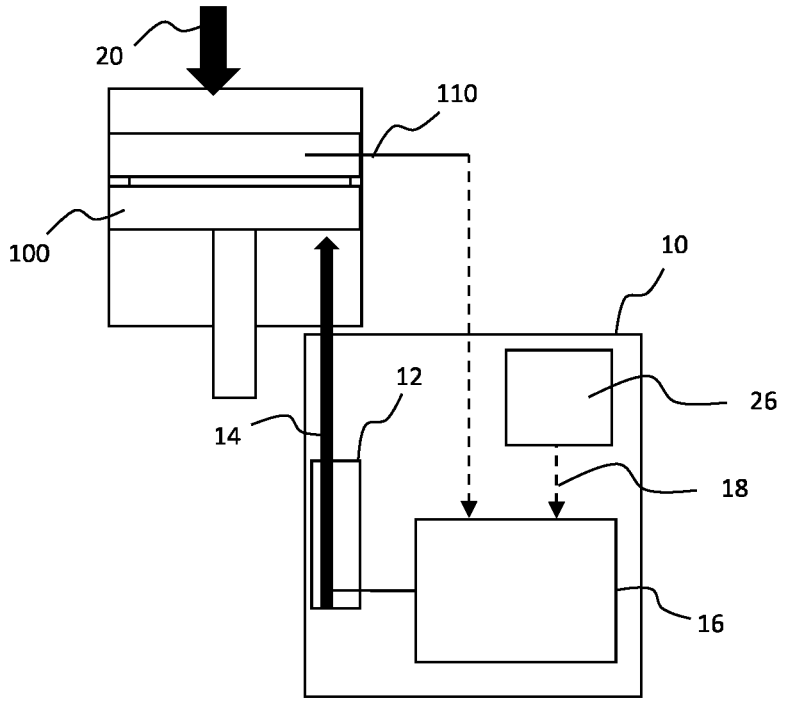
FIG. 3 schematically shows a cooling system for a gas engine piston according to a further development.

In FIG. 3, a cooling system 10 according to another development is shown. According to the illustration shown in FIG. 3, the cooling system 10 may further comprise a user input interface 26 configured to provide the predetermined parameter 18.

The user input interface 26 may be any device suitable to provide the predetermined parameter 18 upon an input of a user. For example, the user input interface 26 may be a device configured to provide the predetermined parameter 18 as a function of a combustion gas 20, as a function of the combustion gas concentration 22, as a hydrogen concentration 24, or as a hydrogen/hydrocarbon gas substitution ratio. The user input itself may consist of the predetermined parameter itself or may be correlated to the predetermined parameter.

Figure 4:
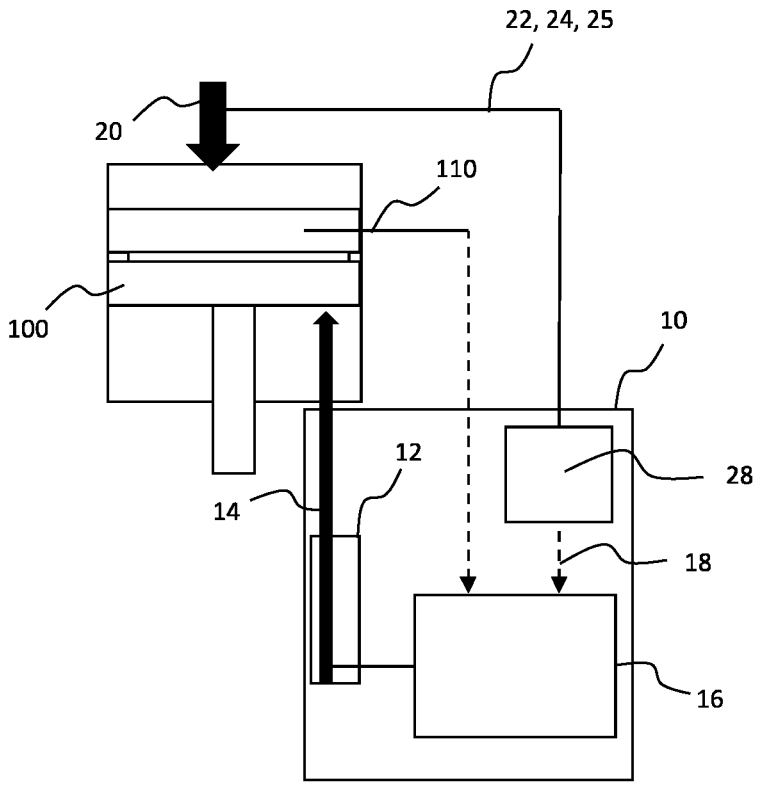
FIG. 4 schematically shows a cooling system for a gas engine piston according to a further development.

In FIG. 4, a cooling system 10 according to another development is shown. Accordingly, the cooling system 10 may further comprise a hydrogen sensor 28 configured to provide the predetermined parameter 18. For example, the hydrogen sensor 28 may be of the WLD-type. The hydrogen sensor 28 may be configured to provide the predetermined parameter 18 without any user input required. The hydrogen sensor 28 may for example provide the predetermined parameter 18 in the form of an analogue or digital signal representing a hydrogen concentration or a hydrogen/hydrocarbon gas substitution ratio.

The hydrogen sensor 28 may be used as the only source proving the predetermined parameter 18. Alternatively, the hydrogen sensor 28 may not be the only source providing the predetermined parameter 18.

Figure 5:
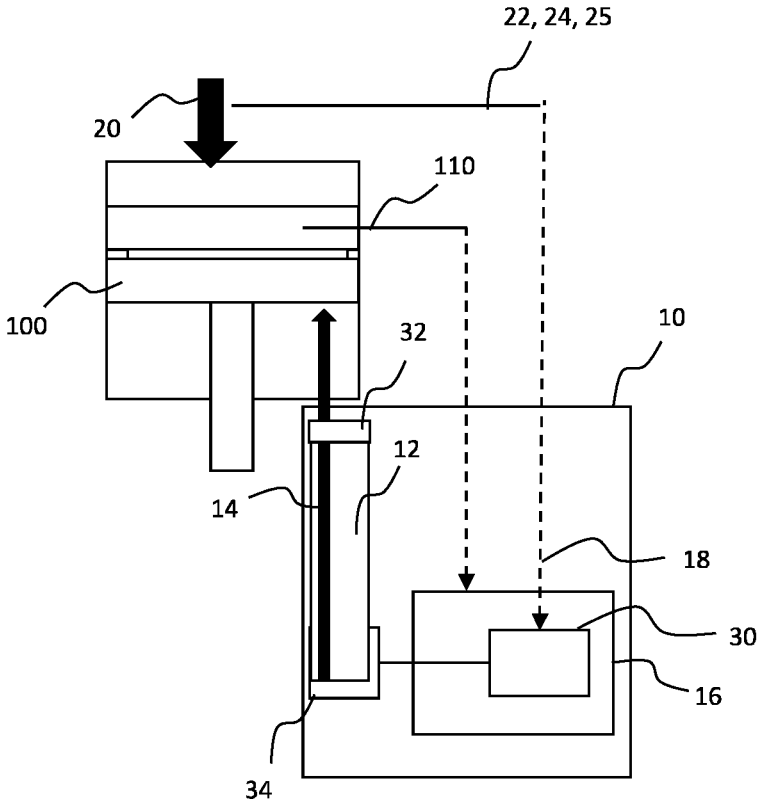
FIG. 5 schematically shows a cooling system for a gas engine piston according to a further development.

In FIG. 5, a cooling system 10 according to another development is shown. The development shown in FIG. 5 is exemplarily based on the development shown in FIG. 2. However, the development shown in FIG. 5 is also compatible with any other development shown in FIGS. 1-4. FIG. 5 may further comprise a lookup table, a correlation and/or an algorithm 30, configured to provide an output to control the cooling oil flow 14. The output may further comprise a piston engine temperature 110.

The output may be a function of a pressure, in particular a cooling oil pressure. Thereby, an output of the control device 16 may be matched to an input of the cooling oil supply 12. The lookup table, the correlation, and/or the algorithm 30 may include empirically obtained data.

According to a further development, the control device 16 may further comprise signal modulation means, configured to generate digital signals from analogue signals.

Further, the cooling oil supply 12 may comprise a nozzle 32, preferably a plurality of nozzles 32. Thereby, a cooling oil flow 14 may be sprayed onto a piston 100, thereby cooling the piston 100.

In addition, a cooling system 10 may further comprise a cooling oil pump 34 configured to increase or decrease cooling oil pressure upon actuation by the controlling device 16 to control the cooling oil flow 14.

Figure 6:
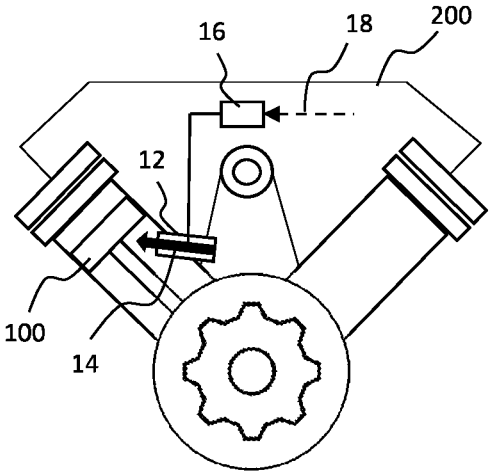
FIG. 6 schematically shows a gas engine according with a cooling system according to the first embodiment.

In FIG. 6, a gas engine 200 according to the present disclosure is shown. The gas engine 200 comprises at least one gas engine piston 12 and a cooling system 10 according to the present disclosure. To this end, the same explanations, definitions, and principles explained in the context of the cooling system 10 above also apply to the gas engine 200.

Therefore, gas engine 200 comprises a cooling oil supply configured to feed a cooling oil flow 14 to the gas engine piston 100 and a control device 16 configured to control the cooling oil flow 14 based at least on a predetermined parameter 18. The gas engine piston 12 is configured to be operable with at least one combustion gas 20. The combustion gas 20 may be a gas comprising hydrogen and/or hydrocarbon gases.

According to a development not shown in FIG. 6, the gas engine piston 12 may be configured to be operable with at least two combustion gases of different hydrogen/hydrocarbon gas substitution ratios, wherein the predetermined parameter 18 is a function of the used combustion gas (20).

Figure 7:
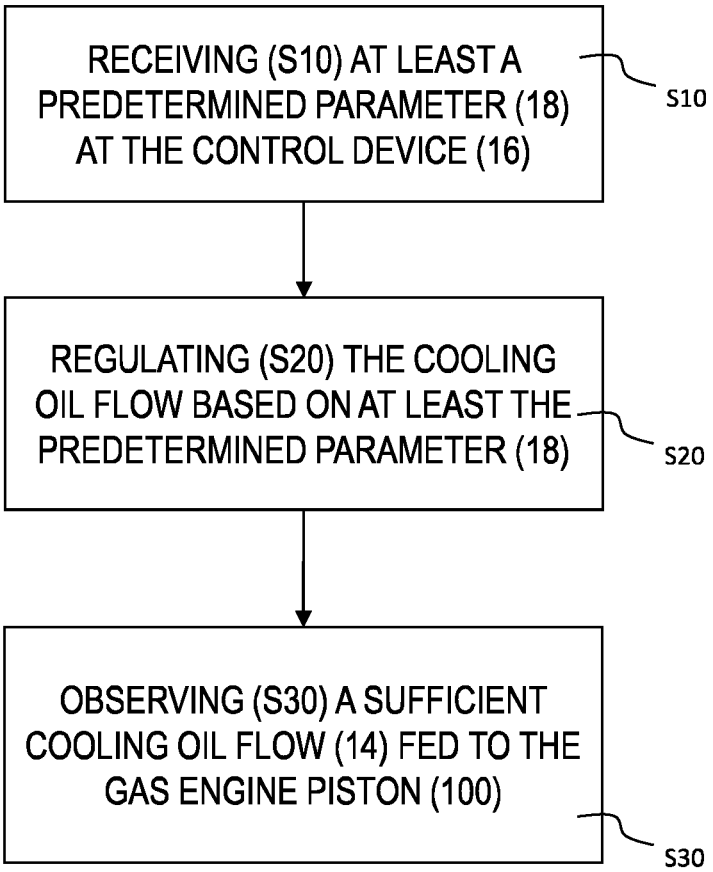
FIG. 7 schematically shows a flow chart according to a first embodiment.

In FIG. 7, a flow chart of a cooling method according to the present disclosure is shown. Accordingly, a cooling method for a gas engine piston 100 is shown, comprising a cooling system 10 according to the present disclosure and the steps of receiving S10 at least one predetermined parameter 18 at the control device 16, controlling S20 the cooling oil flow 14 based on at least the predetermined parameter 18 and observing S30 a sufficient cooling oil flow 14 fed to the gas engine piston 100. Hence, the cooling method shown in FIG. 7 comprises a cooling oil supply 12 configured to feed a cooling oil flow 14 to the gas engine piston 100, and a control device 16. The control device 16 is configured to control the cooling oil flow 14 based on at least the predetermined parameter 18.

The predetermined parameter 18 of the cooling method may for example be a function of a combustion gas 20, a function of a combustion gas concentration 22, a function of a hydrogen concentration 24, and/or a hydrogen/hydrocarbon gas substitution ratio 25.

According to a development not shown in FIG. 7, the step of controlling the cooling oil flow may further comprise a sub-step S22, wherein a cooling oil flow 14 is decreased for an increased hydrogen concentration 24, preferably were in a cooling oil flow is increased for a decreased hydrogen concentration 24.

It will be obvious for a person skilled in the art that these developments and items only depict examples of a plurality of possibilities. Hence, the developments shown here should not be understood to form a limitation of these features and configurations. Any possible combination and configuration of the described features can be chosen according to the scope of the invention.

This is in particular the case with respect to the following optional features which may be combined with some or all developments, items and all features mentioned before in any technically feasible combination. As an example, the cooling system may be for more than one gas engine piston. A gas engine piston may be a component of a gas engine operable with a combustion gas. Further, the gas engine piston, or the gas engine, may be operable with a combustion gas of different hydrogen/hydrocarbon gas substitution ratios.

A cooling system for a gas engine piston may be provided, comprising a cooling oil supply configured to feed a cooling oil flow to the gas engine piston, and a control device configured to control the cooling flow based at least on a predetermined parameter. The gas engine piston may be configured to be operable with combustion gases of at least two different hydrogen/hydrocarbon gas substitution ratios.

In the context of the present disclosure, the term hydrogen may refer to diatomic, homonuclear hydrogen, $H_2$. Likewise, the term hydrocarbon gas may refer to one or more heteronuclear hydrocarbon gases, $C_nH_m$.

In the context of the present disclosure, cooling oil may be an oil taken from an oil sump of a gas engine, for example taken from an area below a crankshaft to which the piston cylinder is mounted. The cooling oil flow may be a flow of cooling oil fed to the gas engine piston via the cooling oil supply, for example to a piston bottom surface.

The cooling oil supply may for example comprise a feed tube via which the cooling oil flow may be fed to the gas engine piston. The control device may be a control unit having an input and an output. Controlling the cooling flow based on at least the predetermined parameter may be understood as taking the predetermined parameter as an input parameter for the control device. Likewise, any signal issued by the control device to control the cooling oil flow may be understood as the output. Controlling the cooling oil flow by the control device may comprise inputting an output of the control device into the cooling oil supply.

The predetermined parameter may be a parameter determined prior to operating the gas engine piston. According to one example, the predetermined parameter may be a parameter determined before the engine starts. According to another example, the predetermined parameter may be a parameter determined before a combustion having a given hydrogen/hydrocarbon gas substitution ratio enters the gas engine piston. According to another example, the predetermined parameter may be understood as excluding real-time parameters during operation such as piston temperatures.

In the sense of the present disclosure, a control, or controlling the cooling oil flow, may refer to a closed-loop or open-loop control. In some cases, control may also refer only to the (one-time) setting of the cooling oil flow prior to or at the start of gas engine piston operation. Setting the cooling oil flow may be achieved by setting the predetermined parameter. The predetermined parameter may be a function of the cooling oil flow or comprise the cooling oil flow in an explicit or implicit form. The cooling oil flow may for example be read from a table.

In a preferred development, the cooling oil supply may further comprise means to restrict and/or exceed a cooling oil flow based on an output of the control device.

A cooling system comprising such a cooling oil supply and a control device configured to control the cooling oil flow based at least on a predetermined parameter has the advantage of being able to avoid a piston temperature-based control approach. Instead of having to continuously control the piston temperature, a governing, predetermined parameter is used. Thereby, the cooling system for a gas engine piston may be reduced in complexity. Hence, the proposed cooling system may be more cost-effective, less prone to failure, and easier to maintain.

According to a further development, the predetermined parameter may be a function of a combustion gas, a function of a combustion gas concentration, a combustion gas concentration, and/or a hydrogen/hydrocarbon gas substitution ratio. This has the advantage that a combustion gas concentration allows to design a cooling system having a reduced control complexity. Hence, the proposed cooling system may be more cost-effective, less prone to failure, and easier to maintain.

Further, this has the advantage that a cooling system may be provided which is suitable for gas engine pistons operated using different hydrogen/hydrocarbon gas substitution ratios.

The hydrogen concentration of a combustion gas is known to have a significant impact on heat generation and propagation in a gas engine piston.

In a preferred development, the control device may be configured such that the cooling oil flow may be restricted when the hydrogen concentration is increased.

It was found that an increased hydrogen concentration in a combustion gas may be associated with a reduced gas engine piston heat up instead of an increased gas engine piston heat up. Accordingly, an increased hydrogen concentration in a combustion gas may be associated with a reduced cooling requirement. With such a control device, it can be avoided that cooling oil is sprayed onto a piston too cold for sprayed-on cooling oil evaporation. Thereby, it can be avoided that cooling oil residuals accumulate on the piston, hence, pre-ignition of the combustion gas may be prevented.

In a preferred development, the control device may be configured such that the cooling oil flow is exceeded when the hydrogen concentration is decreased. Accordingly, a decreased hydrogen concentration in a combustion gas may be associated with an increased cooling necessity. With such a control device, it can be avoided that cooling oil is sprayed onto a piston too cold for sprayed-on cooling oil evaporation. Thereby, it can be avoided that cooling oil residuals accumulate on the piston, hence, pre-ignition of the combustion gas may be prevented.

In a preferred development, the control device may be configured such that the cooling oil flow is at a minimum of the hydrogen concentration is at a maximum. In a further preferred development, the control device may be configured such that the cooling oil flow is a maximum by the hydrogen concentration is at a minimum. In another preferred development, the control device may be configured such that the cooling oil flow is a minimum when the hydrogen concentration is at a maximum. With such a control device, it can be avoided that cooling oil is sprayed onto a piston too cold for sprayed-on cooling oil evaporation. Thereby, it can be avoided that cooling oil residuals accumulate on the piston, hence, pre-ignition of the combustion gas may be prevented.

According to a preferred embodiment, the control device may be configured to control the cooling oil flow further based on a gas piston temperature. Thereby, two inputs may be provided, the gas engine piston temperature and the predetermined parameter. This way, the cooling oil flow may be controlled in a fail-safe manner.

According to a preferred development, the cooling system may further comprise a user input interface configured to provide the predetermined parameter. A user input interface may be any device suitable to provide the predetermined parameter upon an input of a user. For example, the user input interface may be a device configured to provide the predetermined parameter is a function of a combustion gas. Alternatively, the user input interface may be a device configured to provide the predetermined parameter is a function of a combustion gas concentration. Further, the user input interface may be a device configured to provide a predetermined parameter comprising a hydrogen concentration, and/or a hydrogen/hydrocarbon gas substitution ratio.

The user input interface may be configured to provide the predetermined parameter by a (one-time) user input prior to or at the start of gas engine piston operation. The user input may be understood as a sub-step of providing the predetermined parameter. In general, while the predetermined parameter may be understood as an internal parameter used in the cooling system as control input, the user input may be understood as an external input parameter at the user-system interface, the user input interface.

The user input itself may be a function of the predetermined parameter or comprise the predetermined parameter in an explicit or implicit form. Alternatively, the user input may be identical to the predetermined parameter. The user input may be read from a table. Further, the user input interface may comprise an input lookup table for converting a user input into a predetermined parameter.

For example, the predetermined parameter may be a function of or comprise a cooling oil flow. The user input may be a hydrogen concentration or a hydrogen/hydrocarbon gas substitution ratio. The user may retrieve the hydrogen concentration or a hydrogen/hydrocarbon gas substitution ratio from a table or an external combustion gas feed. After the user input is received at the user input interface, the user input interface may then be configured to convert the input hydrogen concentration or hydrogen/hydrocarbon gas substitution ratio into the form of the predetermined parameter, for example into a predetermined parameter being a function of or comprising the cooling oil flow.

Thereby, the user is only required to input easy to understand and accessible information such as a given hydrogen concentration or a given hydrogen/hydrocarbon gas substitution ratio. The conversion of the user input into a cooling oil flow by the user input interface, using the input lookup table, has the advantage that less processing steps at the control device are needed.

Providing a cooling system comprising a user input interface configured to provide the predetermined parameter has the advantage that the predetermined parameter may be obtained by a simple user input, which allows the design a cooling system with reduced complexity.

According to another development, the cooling system may further comprise a hydrogen sensor, preferably of the WLD-type, configured to provide the predetermined parameter. For example, the hydrogen sensor may provide the predetermined parameter in the shape of a combustion gas concentration, preferably in the shape of a hydrogen concentration and/or a hydrogen/hydrocarbon gas substitution ratio.

The provision of a cooling system further comprising a hydrogen sensor configured to provide the predetermined parameter has the advantage that no user input may be required in the control of cooling oil flow by the control device in the cooling oil supply. Thereby, a failsafe, cost-efficient, and easy to operate cooling system for a gas engine piston may be provided.

Hence, a cooling system may be provided allowing to operate a gas engine piston with combustion gases comprising different hydrogen concentrations or hydrogen/hydrocarbon gas substitution ratios without having to adjust the cooling system. Thereby, complexity, costs, and human errors during operations may be further reduced.

Providing a hydrogen sensor of the WLD type has the advantage that such hydrogen sensors are readily available as a proven and reliable technology, allowing to readily access and implement such sensors into a cooling system according to the present disclosure. Thereby, costs associated with development manufacturing and maintenance of cooling systems may be reduced further.

In a preferred development, the control device may further comprise a lookup table, a correlation, and/or algorithm, configured to provide an output to control the cooling oil flow. The generated output may then be fed to the cooling oil supply, enabling the cooling oil supply to control the cooling oil flow based on the output.

The predetermined parameter may be an input of the control device according to the present disclosure. The output may be a substituted signal based on the input predetermined parameter. For example, the output may be retrieved using a lookup table, providing a predetermined output value for a given predetermined parameter received as an input.

Likewise, an output may be generated using a correlation, providing an output value for a given predetermined parameter received as an input. Further, an output may be generated using a calibration correlation, an equation, an approximation, a simulation, and/or an AI based software, providing an output value for a given predetermined parameter received as an input.

Thereby, output values suitable for controlling the cooling oil flow at the cooling oil supply may be generated in an efficient manner.

For example, in a scenario where the predetermined parameter comprises a hydrogen concentration, empirically identified factors and/or correlations may be used to populate a lookup table in the expected ranges of hydrogen concentrations, for example from 0 to 100%. Hence, every time a predetermined parameter is retrieved as an input, an output may be identified via the lookup table. The output is then based on the hydrogen concentration of the predetermined parameter and on the empirically identified factors and/or correlations of the lookup table.

Thereby, a failsafe, cost-efficient, and easy to operate and maintain cooling system for a gas engine piston may be provided. Further, a cooling system for gas engine piston operable for a wide variety of different combustion gases may be provided without necessitating adjustments of the cooling system to the individual combustion gas.

According to a preferred development, the output may be a function of a pressure, in particular a cooling oil pressure. For example, the output may be or comprise an information corresponding to a cooling oil pressure. This has the advantage that the cooling oil flow may be controlled by means of cooling oil pressure variations. Thereby, the cooling oil flow may be controlled by implementing simple fluid dynamic considerations in the design of the control device.

In a preferred development, the cooling oil supply may comprise a nozzle, preferably a multitude of nozzles. The nozzle may be a jet spray nozzle configured to create a cooling oil spray. Providing a nozzle has the advantage that cooling oil may be sprayed onto the surface, for example a bottom surface, of a gas engine piston where the sprayed-on cooling oil may evaporate and thereby cool the piston.

In a preferred development, the cooling system may further comprise a cooling oil pump configured to increase or decrease cooling oil pressure upon actuation by the control device to control the cooling oil flow. The cooling oil pump may be configured to use an output of the control device as an input. The cooling oil pump may be actuated by the control device such that a target pressure is met. Preferably, the cooling oil pump may be calibrated such that for a given output of the control device a given target pressure is met.

Thereby, a simple, cost-efficient, and easy to operate and maintain cooling system for gas engine piston may be provided. Further, a cooling system for a gas engine piston operable with combustion gases of different hydrogen/hydrocarbon gas substitution ratios may be provided.

A gas engine may be provided, comprising at least one gas engine piston and a cooling system according to the present disclosure, wherein the gas engine piston is configured to be operable with at least one combustion gas, preferably with at least two combustion gases having different hydrogen/hydrocarbon gas substitution ratios, wherein the predetermined parameter is a function of the used combustion gas. Pertaining to the cooling system, the above-mentioned explanations, developments, developments, as well as advantages and technical effects may apply accordingly.

A cooling method for a gas engine piston may be provided, comprising a cooling system according to the present disclosure and comprising the steps of receiving at least one predetermined parameter at the control device, controlling the cooling oil flow based on at least the predetermined parameter, and observing a sufficient cooling oil flow fed to the gas engine piston. Pertaining to the cooling system, the above-mentioned explanations, developments, developments, as well as advantages and technical effects may apply accordingly.

Thereby, a simple, cost-efficient, and easy to operate and maintain cooling method for a gas engine piston may be provided.

According to a preferred development, the predetermined parameter may comprise a hydrogen concentration and/or a hydrogen/hydrocarbon gas substitution ratio, wherein the controlling step further comprises a sub-step of decreasing cooling oil flow for an increased hydrogen concentration and/or an increased hydrogen/hydrocarbon gas substitution ratio, and preferably a further step of increasing cooling oil flow for a decreased hydrogen concentration and/or a decreased hydrogen/hydrocarbon gas substitution ratio.

INDUSTRIAL APPLICABILITY

With reference to the Figures, a cooling system for a gas engine piston, a gas engine, and cooling method for a gas engine piston are applicable in any suitable combustion engine, for example internal combustion engines ICEs for gaseous fuels and in particular an ICE operating with combustion gases comprising hydrocarbon-hydrogen gas blends.

In practice, a cooling system for a gas engine piston, a gas engine piston and/or any combination of these various assemblies and components may be manufactured, bought, or sold to retrofit a gas engine, or a gas engine already in the field in an aftermarket context, or alternatively may be manufactured, bought, sold, or otherwise obtained in an OEM (original equipment manufacturer) context.

As alluded to previously herein, the aforementioned developments may provide a simple, cost-effective and reliably operating cooling system for a gas engine piston.

Referring to FIG. 1, there is a development shown disclosing a cooling system for a gas engine disclosing a cooling oil supply configured to feed a cooling oil flow to the gas engine piston, and a control device configured to control the cooling oil flow based on at least the parameter. One skilled in the art will expected various developments of the present disclosure will have an improved simplicity, necessitating less maintenance and less complex adjustment technologies for cooling systems.

The same advantages apply to the remaining figures, in particular to the gas engine comprising such cooling system, and to the cooling method.

The present description is for illustrative purposes only and should not be construed to narrow the breadth of the present disclosure in any way. Thus, those skilled in the art will appreciate that various modifications might be made to the presently disclosed developments without departing from the full and fair scope and spirit of the present disclosure. Other aspects, features and advantages will be apparent upon an examination of the attached drawings and appended claims. As used herein, the articles "a" and "an" are intended to include one or more items and may be used interchangeably with "one or more." Where only one item is intended, the term "one" or similar language is used. Also, as used herein, the terms "has," "have," "having," "include", "includes", "including", or the like are intended to be open-ended terms. Further, the phrase "based on" is intended to mean "based, at least in part, on" unless explicitly stated otherwise.

All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

Certain steps of any method may be omitted, performed in an order that is different than what has been specifically mentioned or in some cases performed simultaneously or in sub-steps. Furthermore, variations or modifications to certain aspects or features of various developments may be made to create further developments and features and aspects of various developments may be added to or substituted for other features or aspects of other developments in order to provide still further developments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A cooling system for a gas engine piston, the system comprising:

a cooling oil supply configured to feed a cooling oil flow to the gas engine piston a sensor configured to measure a predetermined parameter, and a control device configured to control the cooling oil flow based at least on the predetermined parameter comprising a combustion gas concentration, a hydrogen concentration, and/or a hydrogen/hydrocarbon gas substitution ratio.

2. The cooling system according to claim 1, wherein the control device is configured such that the cooling oil flow is restricted when the hydrogen concentration is increased, and wherein the cooling oil flow is exceeded when the hydrogen concentration is decreased.

3. The cooling system according to claim 1, wherein the control device is configured such that the cooling oil flow is at a minimum when the hydrogen concentration is at a maximum, and wherein the cooling oil flow is at a maximum when the hydrogen concentration is at a minimum.

4. The cooling system according to claim 1, wherein the control device is configured to control the cooling oil flow further based on a gas piston temperature.

5. The cooling system according to claim 1, further comprising a user input interface configured to provide the predetermined parameter.

6. The cooling system according to claim 1, wherein the sensor is a hydrogen sensor of the WLD-type, configured to provide the predetermined parameter.

7. The cooling system according to claim 1, wherein the control device further comprises a look-up table, correlation, and/or algorithm configured to provide an output to control the cooling oil flow.

8. The cooling system according to claim 7, wherein the output is a function of a cooling oil pressure.

9. The cooling system according to claim 1, wherein the cooling oil supply comprises a nozzle, or a plurality of nozzles.

10. The cooling system according to claim 1, further comprising a cooling oil pump configured to increase or decrease cooling oil pressure upon actuation by the control device to control the cooling oil flow.

11. A gas engine comprising at least one gas engine piston and a cooling system according to claim 1, wherein the gas engine piston is configured to be operable with at least one combustion gas, wherein the predetermined parameter is a function of the used combustion gas.

12. A cooling method for a gas engine piston, comprising a cooling oil supply configured to feed a cooling oil flow to the gas engine piston, and a control device, comprising the steps of:

receiving at least one predetermined parameter from a sensor, at the control device, the predetermined parameter comprising a combustion gas concentration, a hydrogen concentration, and/or a hydrogen/hydrocarbon gas substitution ratio;

controlling the cooling oil flow based on at least the predetermined parameter; and observing a sufficient cooling oil flow fed to the gas engine piston.

13. The cooling method according to claim 12, wherein the predetermined parameter comprises a hydrogen concentration and/or a hydrogen/hydrocarbon gas substitution ratio, wherein the controlling step further comprises a sub-step of decreasing cooling oil flow for an increased hydrogen concentration and/or an increased hydrogen/hydrocarbon gas substitution ratio, and a further step of increasing cooling oil flow for a decreased hydrogen concentration and/or a decreased hydrogen/hydrocarbon gas substitution ratio.

* * * * *